US006446892B1

(12) United States Patent
Fasoli et al.

(10) Patent No.: US 6,446,892 B1
(45) **Date of Patent: *Sep. 10, 2002**

(54) ROCK CRUSHING MACHINE

(76) Inventors: Ralph Fasoli, 4031 Rundlehorn Dr., N.E. Calgary, Alberta (CA), T1Y 2K2; Emanuel Fasoli, 4031 Rundlehorn Dr., N.E. Calgary, Alberta (CA), T1Y 2K2

( * ) Notice: Subject to any disclaimer, the term of this patent is extended or adjusted under 35 U.S.C. 154(b) by 0 days.

This patent is subject to a terminal disclaimer.

(21) Appl. No.: 07/988,298

(22) Filed: Dec. 10, 1992

(51) Int. Cl.[7] ..... B02C 2/06

(52) U.S. Cl. ..... 241/207; 241/208; 241/209; 241/210; 241/211; 241/212; 241/213; 241/214; 241/215; 241/216

(58) Field of Search ..... 241/207, 208, 241/209, 210, 211, 212, 213, 214, 215, 216, 286, 290

(56) References Cited

U.S. PATENT DOCUMENTS

| | | | | | |
|---|---|---|---|---|---|
| 3,604,640 | A | * | 9/1971 | Webster | 241/215 |
| 3,614,023 | A | * | 10/1971 | Archer et al. | 241/202 |
| 3,743,193 | A | * | 7/1973 | DeDiemar et al. | 241/207 |
| 3,754,716 | A | * | 8/1973 | Webster | 241/208 |
| 3,774,858 | A | * | 11/1973 | Archer et al. | 241/285 R |
| 3,887,143 | A | * | 6/1975 | Gilbert et al. | 241/215 |
| 3,985,308 | A | * | 10/1976 | Davis et al. | 241/290 |
| 3,985,309 | A | * | 10/1976 | Davis et al. | 241/290 |
| 4,174,814 | A | | 11/1979 | Warren | |
| 4,192,472 | A | * | 3/1980 | Johnson | 241/215 |
| 4,198,003 | A | * | 4/1980 | Polzin et al. | 241/30 |
| 4,206,881 | A | | 6/1980 | Werginz | |
| 4,391,414 | A | * | 7/1983 | Reiter | 241/213 |
| 4,477,030 | A | * | 10/1984 | Vifian et al. | 241/208 |
| 4,666,092 | A | * | 5/1987 | Bremer | 241/214 |
| 4,717,084 | A | * | 1/1988 | Vendelin et al. | 241/207 |
| 4,919,348 | A | | 4/1990 | Johnson | |
| 4,919,349 | A | | 4/1990 | Johnson | |

* cited by examiner

*Primary Examiner*—Allen Ostrager
*Assistant Examiner*—William Hong
(74) *Attorney, Agent, or Firm*—Shlesinger, Arkwright & Garvey LLP

(57) ABSTRACT

The machine is comprised of a main body (32), a bonnet (14) which rests on the upper frame of the main body (32) and a concave holder (66) threadably inserted into the bonnet (14). The bonnet (14) is maintained in intimate contact with the main body (32) by means of a plurality of tramp iron cylinders (18) while the concave holder (66) is screwed into the bonnet (14) by means of an adjusting gear (16) and matching pinion (58). The concave holder (66) is locked in position within the bonnet (14) by means of a plurality of locking cylinders (60) positively engaging a locking slide ring (64). A mantle (70) covered male conical member (28) is driven by a crown gear (36) and pinion (52) in an elliptical rotation within the confines of a concave die (68) thus crushing the raw rock on each near pass. The concave holder (66) will automatically lift and/or tilt off of the bonnet (14) in response to the individual or collective actions of the tramp iron cylinders (18) and their matching accumulators (80) which are reactive to an excess loading between the male conical member (28) and its mantle (70) and the concave die (68). A two part stepped slip seal (22) and (24) provide containment of excess lubricant while excluding abrasive particles from contact with critical components. The seal is incorporated as part of a thrust support (20) which rides against the underside of the male conical member (28) and absorbs crushing loads transmitted via the male conical member (28) and the concave die (68).

4 Claims, 5 Drawing Sheets

Figure 1:
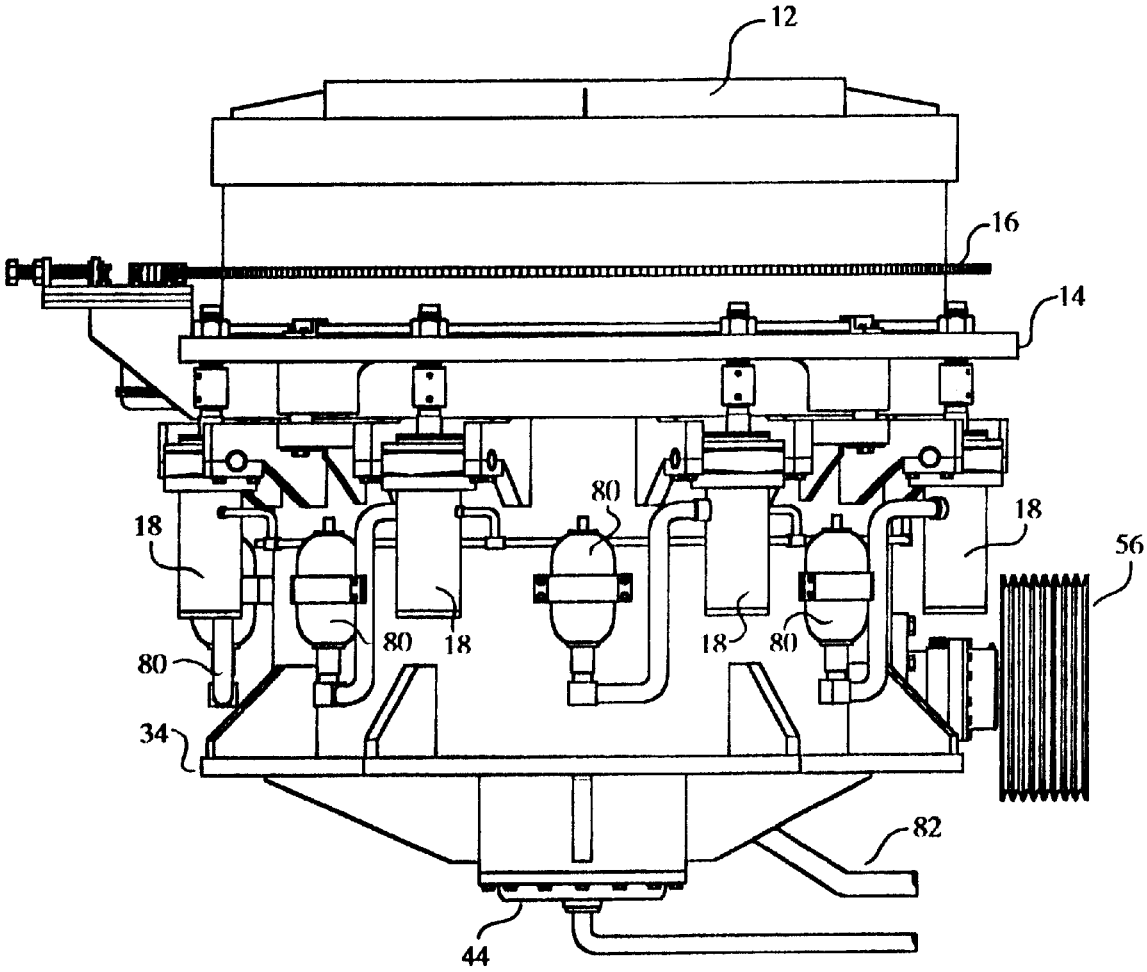

FIG 4A
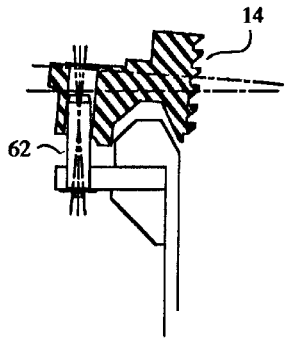
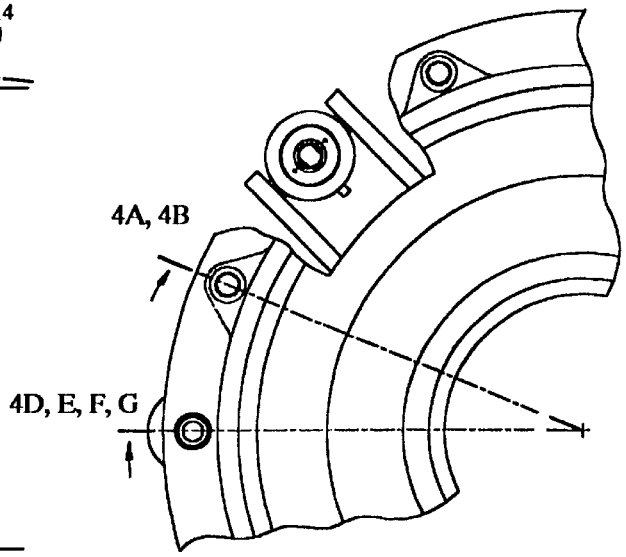
FIG. 4C
FIG. 4B
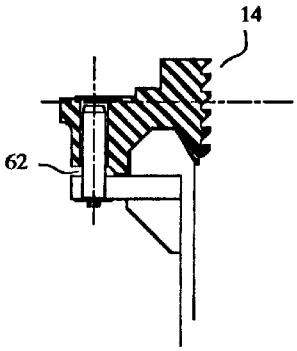
FIG. 4D
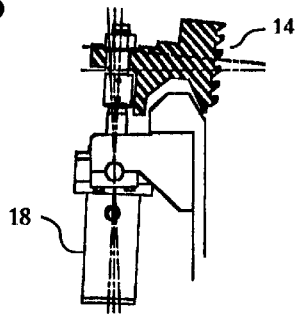
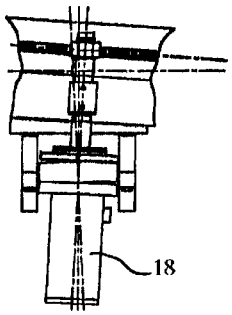
FIG. 4F
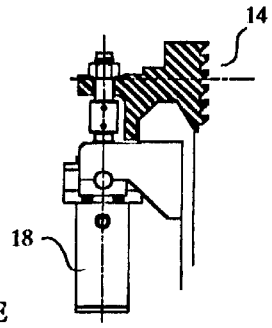
FIG. 4E
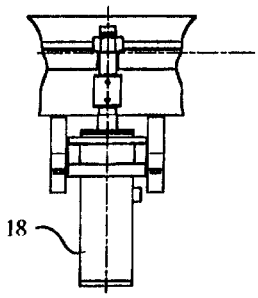
FIG. 4G FIG. 5A
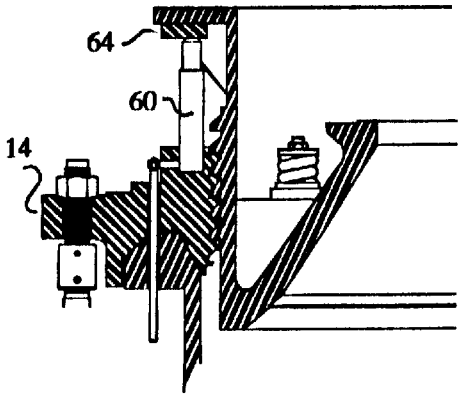
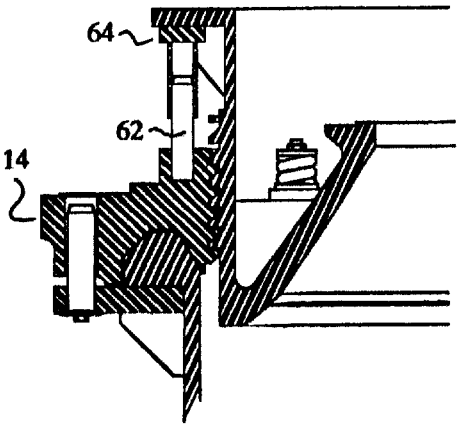
FIG. 5B
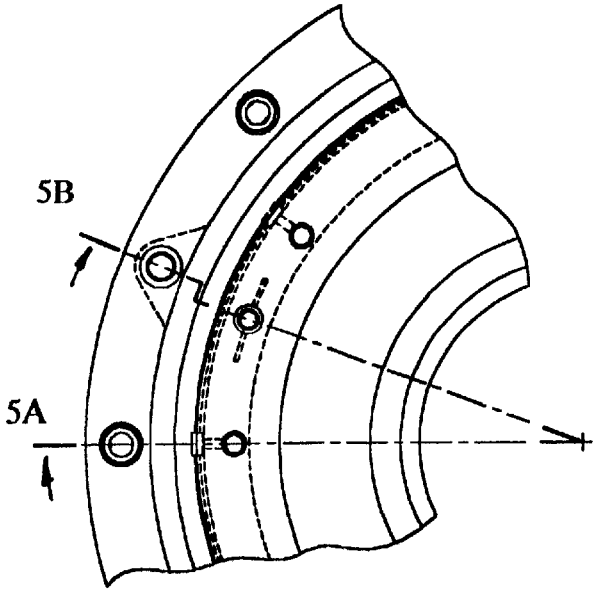
FIG. 5C

ROCK CRUSHING MACHINE

BACKGROUND—Field of invention

This invention relates to an apparatus for the crushing of rocks, more specifically to an apparatus of conical construction.

BACKGROUND—Description of Prior Art

Mechanisms designed to facilitate the automatic crushing of rocks have been the subject of much creative activity by inventors over the years, progressing from the use of simple, hammer-like devices to the current generation of gyrating conical crushers.

Of the latter design there are many machines or apparatuses for crushing rocks described in the patent literature. Examples of such machines or apparatuses are found in U.S. Pat. No. 4,206,881 which issued to K. Werginz, on Jun. 10, 1980, U.S. Pat. No. 4,174,814 which issued to K. D. Warren et al on Nov. 20, 1979, and U.S. Pat. No. 4,919,349 and U.S. Pat. No. 4,919,348 which issued to L. W. Johnson et al on Apr. 24, 1990.

Inventive activity in this particular field is not, of course, confined solely to the United States as revealed by the patent literature of countries foreign to the United States. For example; Brazil patent number 7,800,884 issued to H. Murata et al on Sep. 19, 1978 and (former) Soviet Union patent Nos. 592,440 issued to V. G. Kravchenko et al on Mar. 28, 1978, 461,740 issued to V. A. Maslennikov on Sep. 10, 1975, 1,620,136 issued to Y. U. V. Gudkov et al on Nov. 05, 1991 and 1,506,106 issued to E. G. Fonbershte et al on Sep. 07, 1989.

All of the above mentioned patents disclose what is essentially an eccentrically mounted conical member rotating within the confines of a cooperating conical concave member such that as the rotation of the eccentrically spinning cone approaches its closest distance to the concave, any rocks introduced between the two members will be crushed.

While the basic operational concept has remained consistent from one conical design to the other, the methods of implementation have varied considerably as in, for example, the method of lubrication and sealing and the facilities developed for clearing and cleaning following a stall or blockage condition.

Not surprisingly, there are occasions, during normal operation, when non-crushable items are inadvertently introduced into the crushing cavity, hence most designs incorporate a clearing mechanism in one form or another which will permit the passage of such items through the system without major damage to the system components.

While it can be said that some designs are more effective than others in the manner in which the above mentioned operational problems are addressed, all designs heretobefore known suffer from the following shortcomings:

(a) the methods of clearing non-crushable items are less effective than desireable;

(b) cavity clearing following stall or overload conditions tend to be time consuming and labour intensive;

(c) the natural tendency to imbalance inherent in the design of a gyrating cone is not always adequately addressed;

(d) conventional devices are usually large and cumbersome;

(e) conventional devices tend to require frequent and difficult maintenance;

(f) adjustment of crusher settings is seldom possible under load; and (g) problems are frequently encountered in respect to lubrication and sealing of critical components.

OBJECTS AND ADVANTAGES

Accordingly several objects and advantages of the present invention are:

(a) to provide a cone crusher capable of clearing non-crushable items automatically and effectively;

(b) to provide a cone crusher with instantaneous response to overload conditions and rapid and automatic restoration to original settings following overload;

(c) to provide a cone crusher more readily adaptable to remote control than the prior art devices;

(d) to provide a cone crusher wherein each individual device is capable of optimum balance;

(e) to provide a cone crusher incorporating a relatively simple but effective lubrication and sealing system; and (f) to provide a cone crusher incorporating efficient cavity clearing facilities thus reducing machine "down time."

Further objects and advantages are to provide a relatively low maintenance cone crusher. An additional object and advantage is to provide a cone crusher of compact design wherein said crusher is ideal for portable plant mountings or stationary installations where headroom is at a premium. Still further objects and advantages will become apparent from a consideration of the ensuing drawings and description.

DRAWING FIGURES

In the drawings closely related figures have the same number but different alphabetical suffixes.

FIG. 1. is a side elevation view of the cone crusher showing the relative positioning of external components.

Figure 2:
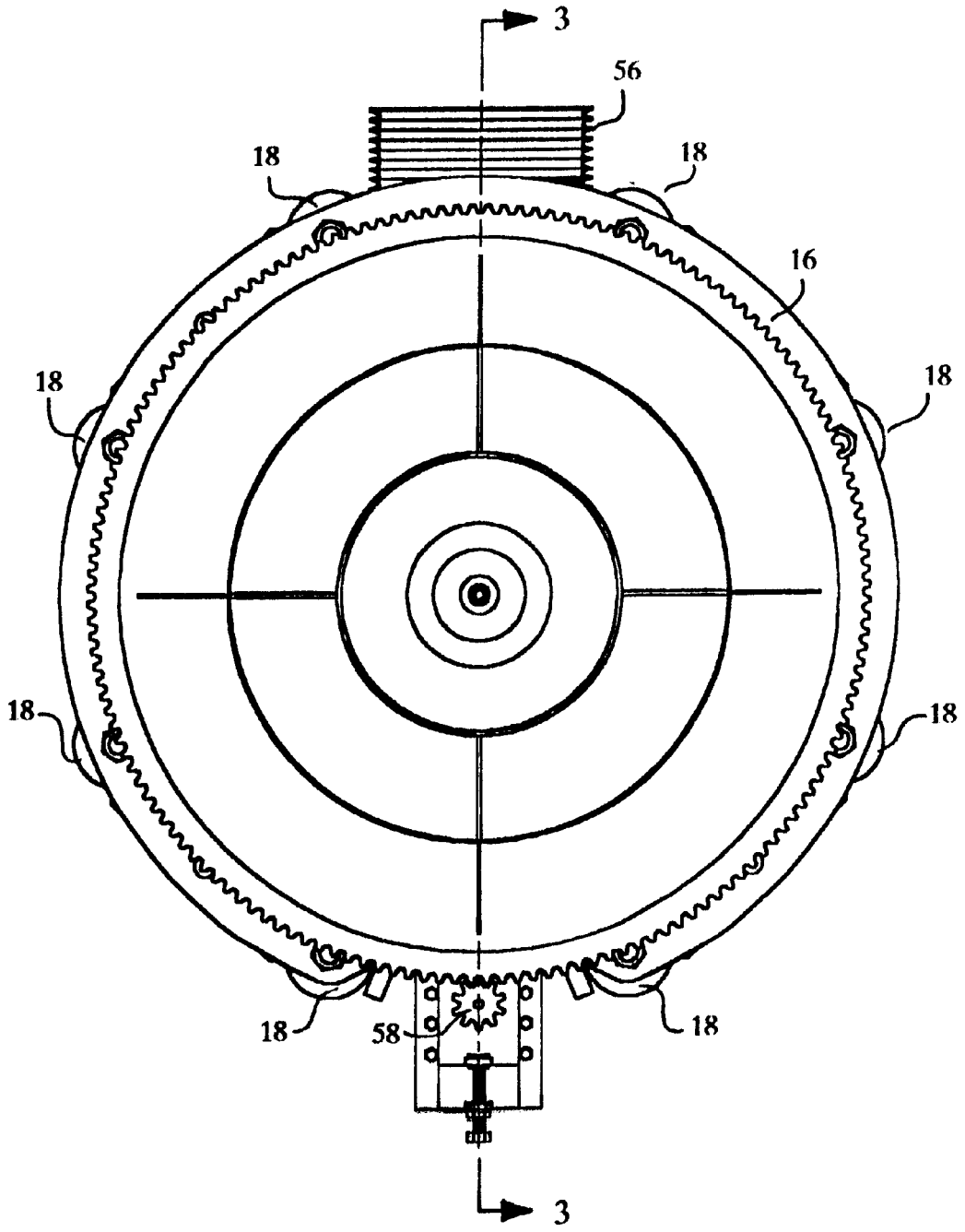

FIG. 2. is a simplified top view of the cone crusher showing the relative positioning of some of the external components.

Figure 3:
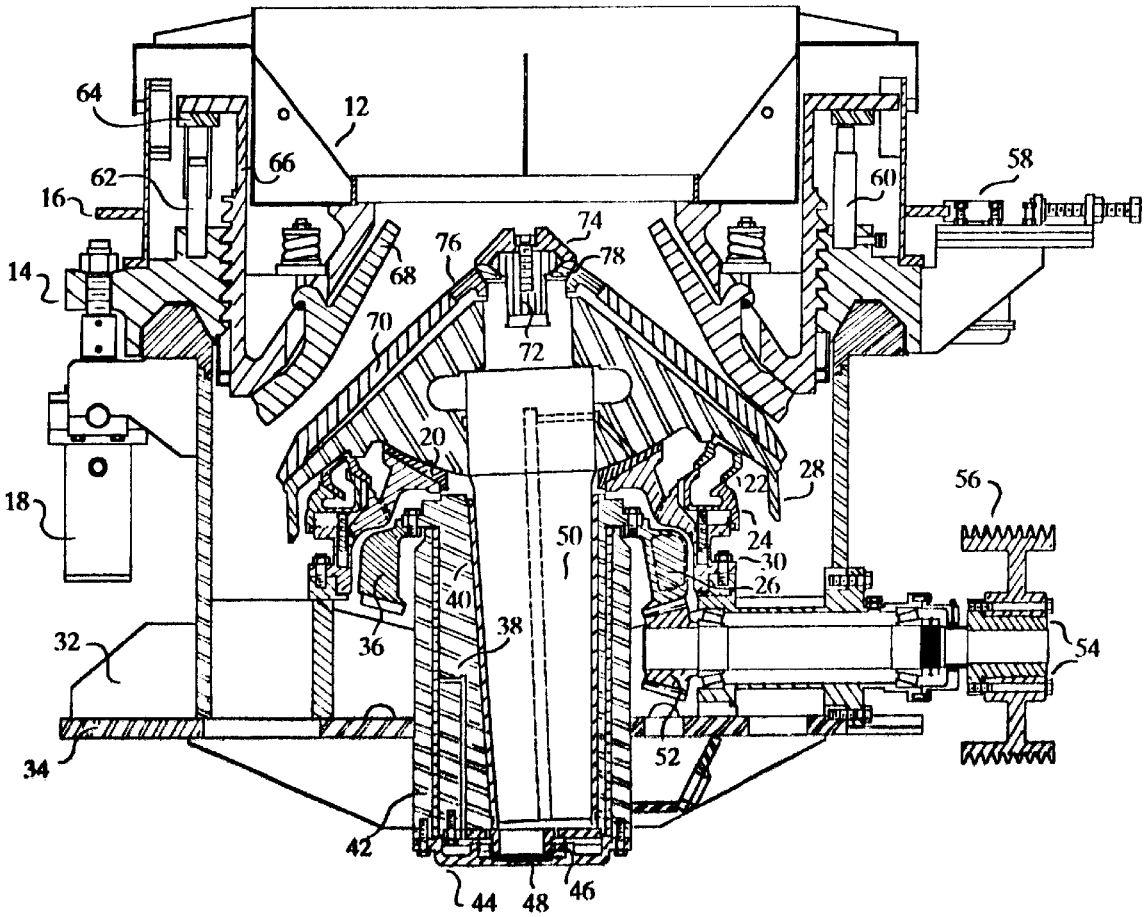

FIG. 3. is a sectional view of the cone crusher taken in the plane 3—3 of FIG. 2.

FIGS. 4A, to 4G inclusive are schematic views of the alternate positioning of several major components of the tramp iron release system.

FIGS. 5A to 5C inclusive are schematic views of the various guide pin mechanisms.

COMPONENT REFERENCE NUMERALS IN DRAWINGS

| | | | |
|---|---|---|---|
| 12 | feed basket | 14 | bonnet |
| 16 | adjusting gear | 18 | tramp iron release cylinder |
| 20 | thrust support | 22 | top seal |
| 24 | lower seal | 26 | counter balance weight |
| | gyratory head | 30 | thrust support |
| 32 | main body | 34 | body base |
| 36 | crown gear | 38 | eccentric |
| 40 | eccentric bushing | 42 | frame bushing |
| 44 | bottom cover | 46 | thrust bearing |
| 48 | adjusting shim | 50 | gyratory shaft |
| 52 | drive pinion | 54 | shive bushings |
| 56 | drive pulley | 58 | adjusting pinion |
| 60 | locking cylinder | 62 | guide pin |
| 64 | locking slide ring | 66 | concave holder |

-continued

| | | | |
|---|---|---|---|
| 68 | concave die | 70 | mantle die |
| 72 | gyratory shaft bolt | 74 | bolt cover |
| 76 | manganese extension | 78 | burn out ring |
| 80 | accumulators | 82 | oil discharge port |

Description—FIGS. 1 to 3

The cone crusher of the present invention is comprised of a generally cylindrical main body 32 fabricated from rigid, robust material and incorporating on the outer surface permanently affixed ribbing for the purposes of adding rigidity and strength to the overall structure. The main body 32 further includes a variety of permanently affixed fabricated mounting panels and plates to accommodate the secure mounting of a variety of external components such as accumulators 80 and tramp iron release cylinders 18.

A generally circular rigid, robust body base 34 having a uniform wall thickness is permanently affixed to the lower end of the main body cylinder 32 by conventional means, such as welding, and thus closes the lower opening of the main body 32 while concurrently providing for internal component mounting.

A generally circular bonnet 14 of rigid, robust material having internal threads and incorporating a variety of fabricated mounting points to accommodate such external components as the tramp iron release cylinders 18 and a plurality of guide pins 62 is removably insertable over the wall of the main body 32 such that the bonnet 14 forms a vertical extension to the length of the main body 32, is free to pivot off the vertical and provides a treaded receptacle for the insertion of a concave holder 66.

The concave holder 66 consists of a generally cylindrical structure of robust rigid material having external threads of a design and type such that the concave holder 66 is threadably insertable into the bonnet 14 and incorporating on the external surface thereof a permanently affixed adjusting gear 16 wherein said adjusting gear 16 is a ring gear and meshes with and is driven by an adjusting pinion 58 which is, in turn, rotated by conventional means such as a hydraulic motor (not shown).

The concave holder 66 further includes a variety of fabricated mountings and machined apertures postitioned to accommodate and cooperate with a plurality of guide pins 62 and locking cylinders 60 wherein said guide pins 62 and locking cylinders 60 maintain the concave holder 66 in position with the bonnet 14.

A generally cylindrical feed basket 12 fabricated from robust rigid material is removably attachable to the upper end of the concave holder 66 and provides for an orderly ingress of crushable materials to the internal cavity of the main body 32.

An inverse conical concave die 68 having tapered wall thickness and formed from rigid, robust material is suspended within the confines of the concave holder 66 by means of attachment to a plurality of spring loaded holders cooperating with an annular hooked extension integral to the outer surface of the concave die 68 and substantially centred thereon.

An eccentrically bored sleeve 38 is centrally located within the main body 32 cavity and the body base 34 and incorporates within the eccentric bore an eccentric bushing 40 within which a gyratory shaft 50 is mounted. Both the eccentric 38 and the shaft 50 incorporate drilled lubricant passages to facilitate the distribution of lubricant to critical components of the system.

An adjusting shim 48 is affixed to the bottom of the eccentric 38 by conventional means and supports the eccentric 38 while facilitating lubricated rotation on a thrust bearing 46, which bearing 46 transmits the load of the eccentric 38 to a bottom cover 44 attached to the body base 34 by conventional means.

A crown gear 36 is attached by conventional means to the eccentric 38 in a horizontal plane and meshes with a drive pinion 52 which drive pinion 52 is removably insertable through a machined opening in the main body 32 and supported within the confines of its housing by means of dual tapered roller bearings. A multi-belt pulley 56 is affixed by conventional means to the outer end of the drive pinion 52 faciltating the application of motive power to the machine.

A generally cone shaped gyratory head 28 fabricated from robust, rigid material and incorporating on its undersurface a top seal 22 is removably inserted over the shaft 50. A generally coned shaped mantle die 70 incorporating an abrasive resistant manganese extension 76 is also removably inserted over the shaft 50 on top of the head 28. The head 28, the mantle die 70 and manganese extension 76 are located over the shaft 50, overlaid by a burn out ring 78 formed from material less abrasive resistant than the manganese extension 76, and secured to the shaft 50 by means of a gyratory shaft bolt 72 and bolt cover 74.

A generally circular and stepped thrust support 20 incorporating a lower seal is positioned centrally to and on the main body 32 and rides against the undersurface of the gyratory head 28 and provides a lubricated, contoured surface to support the head 28. The lower seal 24, supported by the thrust support 20 is maintained in close alignment with and provides a slip seal, seal by means of a plurality of springs and plungers arranged such as to apply upward pressure to the undersurface of the lower seal 24.

Operation—FIGS. 1 to 5C Inclusive

The main body 32 houses the drive pinion 52, crown gear 36, the gyratory shaft assembly comprised of the shaft 50, bushing 40, eccentric 38, thrust bearing 46, adjusting shim 48 and bottom cover 44, the gyratory head assembly comprised of the head 28, the mantle die 70, manganese extension 76, burn out ring 78, shaft bolt 72, bolt cover 74 and upper seal 22, and the support assembly comprised of the thrust support 20 and lower seal 24.

The body base 34 is affixed to the bottom of the main body 32 and provides a seal to the main body 32 and a lubricant reservoir.

The gyratory head 28 rotates upon the thrust surface of the thrust support 20 and transmits the forces generated during crushing operations to the thrust support 20. The slip seal formed by the actions of the upper seal 22 and lower seal 24 provides protection from the unwanted ingress of rock dust between the surfaces of the thrust support 20 and the underside of the head 28 while preventing the escape of lubricant.

The gyratory head 28 is attached to the shaft 50 and rotates with the shaft 50. The head 28 supports the mantle die 70 and absorbs the forces generated during crushing, which forces are further transmitted to the thrust support 20.

The manganese extension 76 of the mantle die 70 expands in service and is thus difficult to remove without the inclusion of the burn out ring 78, which ring 78 may be "cut out" using, for example, gas welding means. The burn out ring, then, faciltates removal of the manganese extension 76 and the mantle die 70 and can therefore be considered as a sacrificial component The gyratory shaft 50 is free to rotate within the confines of the eccentric bushing 40 and will rotate within the eccentric 38 as the eccentric 38 rotates. The shaft 50 is inserted into the sleeve 38 in an offset position causing a wobble as the shaft 50 rotates. It is, of course, this wobble which represents the working concept of the machine.

The thrust bearing 46 acts to transmit the eccentric 38 loads to the bottom cover 44. Note that the thrust bearing 46 does not support the shaft 50 or the rock crushing process. The thrust bearing 46 and the adjusting shim 48 combine to prevent wear on the surface of the bottom cover 44.

The concave die 68 is fabricated in differing "sizes" appropriate to the production of fine grain rock, medium grain and course grain rock, each of which size is interchangeable within the machine.

The concave holder 66 is threaded into the bonnet 14 until secure. It is secured when the locking ring 64 catches onto the locking cylinders 60. In this position there will be a small gap between the mantle die 70 and the concave die 68 in the lowside position.

The concave holder 66 is screwed into position by the adjusting gear 16 driven by the rotation of the adjusting pinion 5. The bonnet 14 rests on the upper surface of the main body 32 and the bolts extending from the tramp iron release cylinders 18 are secured to the bonnet 14. The bonnet 14 can thus be lifted by the action of the tramp iron release cylinders 18, which action is required to relieve overload in case of joining of rock or for clearing of rock from the machine.

The concave holder 66 is threaded into the bonnet 14 until secure. The seal between the bonnet 14 and the main body 32 incorporates some "give" or gap to allow for one sided lifting or tilting of the upper assembly which tilting action is controlled by the tramp iron release cylinders 18.

The tramp iron release cylinder 18 is essentially a hydraulic plunger. Each cylinder 18 is connected by hydraulic line to an accumulator 80. The accumulator 80 is slightly filled with oil and mostly gas on top, with the gas maintained at a predetermined pressure. If a rock or other object jams the machine, the top assembly will lift, which in turn will lift the plunger in the release cylinder 18. Hydraulic fluid is thus forced out of the cylinder 18 and into the bottom of the accumulator 80. A pressure imbalance between the gas and the fluid results in further lifting of the top assembly thus clearing the jam. The tramp iron release cylinders 18 can work in unison to lift the entire upper assembly to faciltate cleaning, however, the cylinders 18 can also work individually to provide lift on one side or the other of the upper assembly to faciltate automatic clearing of jams.

The guide pins 62 are inserted into the body of the bonnet 14 extending vertically, thus controlling vertical motion of the locking slide ring 64 during initial concave holder 66 rotation as the holder 66 is threaded into the bonnet 14. By means of the control action thus provided by the guides 62 potentially damaging torsional loads applied to the cylinders 60 while said cylinders 60 have not yet reached their fully engaged position are avoided. The slide ring 64 serves as an interface between the concave holder 66 and the locking cylinders 60.

Accordingly the reader will see that the cone crusher of the present invention provides an effective and automatic means for the clearing of jams while also facilitating ease of cleaning. Furthermore the cone crusher of the present invention has the additional advantages in that

- it provides for an effective sealing method whereby rock dust is substantially prevented from entering critical components.
- it requires a minimum of operating personnel since most of its operation is automatic or can be readily adaptable to full automation.
- it places few demands on the technical skills of the operators; and
- by providing for the removal of all major components from the top reduces repair and maintenance time and thus downtime.

Although the description herein contains many specifications, these should not be construed as limiting the scope of the present invention but as merely providing an illustration of the presently preferred embodiment of the invention. Thus the scope of the invention should be determined by the appended claims and their legal equivalents, rather than by the examples provided.

What is claimed is:

1. A crusher comprising:

a body containing a gyratory conical head, an intermediate member supported above the body having a helical threaded connection to an upper member, the upper member supporting a concave die that cooperates with the conical head for crushing material in a gap defined between the conical head and the concave die, the gap being adjustable by helical rotation of the upper member relative to the intermediate member, the intermediate member and the upper member each having opposed surfaces extending radially away from the threaded connection; and at least one hydraulic jack disposed between the opposed surfaces whereby extension of the at least one hydraulic jack urges the upper member away from the intermediate member thereby preventing rotation of the upper member relative to the intermediate member and, retraction of the at least one hydraulic jack permits rotation of the upper member relative to the intermediate member.

2. The crusher of claim 1, wherein the at least one hydraulic jack is mounted on one of the opposing surfaces and engages the other of the opposing surfaces when extended.

3. The crusher of claim 2, wherein the opposing surface engaged by the at least one hydraulic jack comprises a ring in slideable contact with the at least one hydraulic jack.

4. The crusher of claim 1 further comprising at least one telescoping guide between the opposed surfaces to limit lateral movement of the upper member relative to the intermediate member.

* * * * *